United States Patent [19]

Urban et al.

[11] 4,430,075

[45] Feb. 7, 1984

[54] DOSING TIP

[75] Inventors: Joseph J. Urban, Richboro, Pa.; Herbert E. Huckel, Peapack, N.J.

[73] Assignee: Hoechst-Roussel Pharmaceuticals Inc., Somerville, N.J.

[21] Appl. No.: 288,823

[22] Filed: Jul. 31, 1981

[51] Int. Cl.[3] ..... A61J 7/00

[52] U.S. Cl. ..... 604/77

[58] Field of Search ..... 128/222, 252, 360, 239; 222/205, 386, 393; 604/77, 78, 48, 275

[56] References Cited

U.S. PATENT DOCUMENTS

| | | | |
|---|---|---|---|
| 2,537,583 | 1/1951 | Griesinger | 128/252 |
| 2,569,139 | 9/1951 | Abelson | 128/252 |
| 2,831,484 | 4/1958 | Garner | 128/252 |
| 3,165,241 | 1/1965 | Curry | 128/252 X |
| 3,391,830 | 7/1968 | Kitchens | 128/222 X |
| 3,727,802 | 4/1973 | Schnurmacher | 128/222 X |

*Primary Examiner*—John D. Yasko

*Attorney, Agent, or Firm*—Leonard S. Selman

[57] ABSTRACT

An improved dosing tip having a tapered portion for application to the mouth of a host for administering a dose of medicament, food, vitamins, or the like, including gripping means on the tapered portion for being firmly engaged by the teeth, lips, gums, or jaws of the host and for readily releasing said tapered portion upon terminating the administration of the dose to the host.

8 Claims, 11 Drawing Figures

DOSING TIP

BACKGROUND OF THE INVENTION

1. Field of the Invention

This invention relates to a dosing tip and more particularly to a dosing tip having an especially configured mouth-receiving portion providing ease of insertion into the mouth of a host, including means for providing firm engagement by the teeth, lips, gums, or jaws thereof, while delivering the dose and for readily releasing the tip from the mouth upon completion of the dosing.

2. Description of the Prior Art

Dosing systems are known which are commonly referred to as "syringe" type or "caulking gun" type delivery systems used for administering drugs, medicines, vitamins, and the like, referred to herein as medicaments, to animal or human recipients. These type systems have in common a structure including a chamber for receiving the medicament and a plunger type mechanism for forcing the medicament out of the chamber and through a tip into the mouth of the recipient. None of these conventional systems, however, fully achieve certain requisites in the functional areas of easy insertion and retention in the mouth of the recipient as well or easy removal when dosing is completed. The dosing tip herein disclosed does obtain these advantages and is especially useful for dosing a large number of animals, such as a herd of cattle, quickly and safely using in certain embodiments thereof available devices such as a common caulking gun available in any hardware store at an economical price.

SUMMARY OF THE INVENTION

This invention is directed to a dosing tip and more particularly to a dosing tip having an especially configured mouth receiving portion providing ease of insertion into the mouth of a host, including means for providing firm engagement by the teeth, lips, gums or jaws thereof, while delivering the dose and for readily releasing the tip from the mouth upon completion of the dosing.

The dosing tip comprises a body having a tapered end portion for ease of insertion into the mouth of a host and a conduit extending through the tip body for passing a dose through an outlet opening in said tapered end portion into the mouth of the host. There is an especially manufactured and configured gripping means provided on said tapered end portion of the tip body for being firmly engaged by the teeth, lips, gums or jaws of the host and for being readily releasable upon terminating the administration of the dose to the host.

BRIEF DESCRIPTION OF THE DRAWINGS

A more comprehensive understanding of the invention may be had by considering the following drawing in conjunction with the detailed description, wherein.

DESCRIPTION OF THE INVENTION

Figure 2:
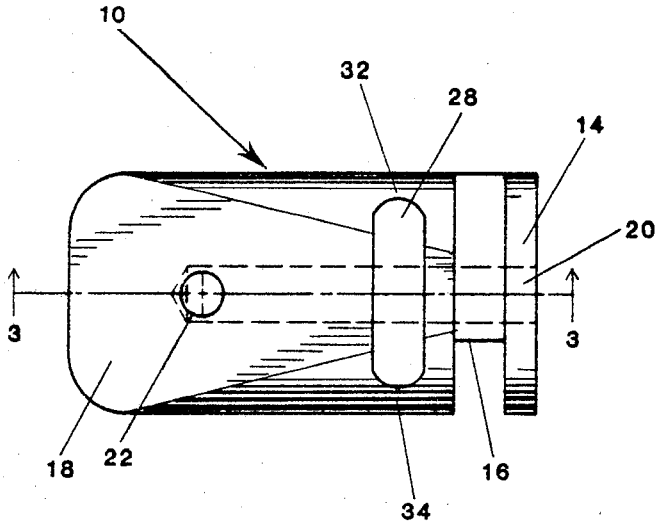
FIG. 2 is a top plan view of the dosing tip of FIG. 1.
Figure 1:
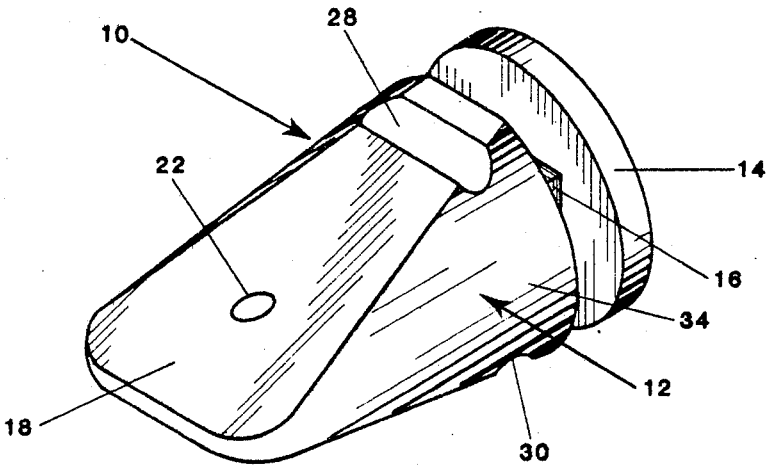
FIG. 1 is a perspective view of a dosing tip of the invention.
Figure 3:
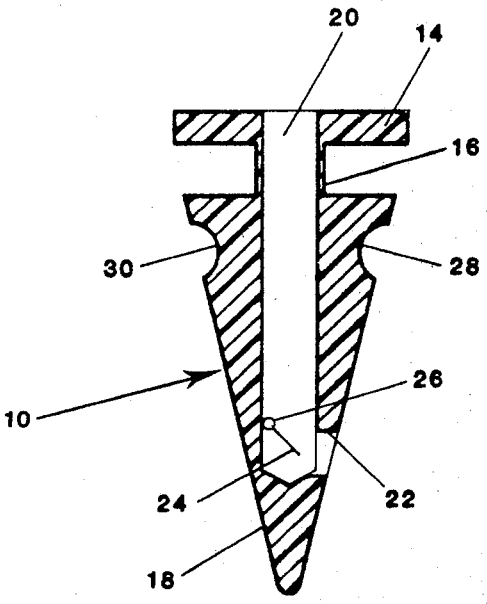
FIG. 3 is a sectional view of the dosing tip taken along line 3—3 of FIG. 2.

Referring more particularly to the drawings wherein like reference numerals designate like parts throughout the several views, FIG. 1 is a perspective view of a dosing tip 10. The tip includes a body 12 having at one end a flange 14 connected by a neck portion 16 to a tapered front end portion 18 intended to be inserted into a mouth of a medicament host. A conduit means 20 as shown most clearly in FIG. 2 extends parallel to or along the longitudinal axis of the tip 10 extending through the flange 14 neck portion 16 and terminates in the tapered end of the mouth receiving front end portion 18. An aperture 22, through which the medicament is intended to pass into the mouth of the host is located in the tapered end portion 18 and intersects with the conduit means 20. As shown in FIG. 3, there may be positioned at the base of the opening a flow regulator mechanism of a known type. For example, the flow regulator may consist of a closure element 24 which is biased by coil spring 26 into a restricting or substantially closed position except when the pressure upon the end facing the source of flow of the medicament overcomes the spring tension whereupon element 24 will open and permit the flow of the medicament out of opening 22.

Referring to FIGS. 1 and 3, independently configured gripping means are provided on the dosing tip in the form of a constriction element 28 located on the tapered end portion 18 of the dosing tip 10. The constriction element 28 is preferably formed by a depression in the end portion 18 as shown in profile in FIG. 3. There is at least one element 28 and preferably there are two opposing elements 28 and 30 spaced circumferentially apart from each other by smooth body portions 32 and 34 as shown in FIGS. 1 and 2.

In operation, referring back to FIG. 1, the dosing tip 10 is inserted into the mouth of a recipient designated to receive medicament, that is an animal, for example, and the tapered front portion 18 of the tip 10 wedges itself in the recipient's mouth for easier penetration. When the tip 10 is inserted far enough, the constriction element 28 or elements 28, 30 are positioned so that the lips, teeth, gums or jaws of the recipient engage the elements 28, 30 so that the tip 10 is held tightly as the dose is administered. To remove the tip 10, the tip 10 is turned approximately 90 degrees so that the lips, teeth, gums, or jaws are released from the elements 28, 30 and cammingly engage the smooth rounded portions 32 and 34 of the tip body and thus the tip 10 is easily slipped out of the recipient's mouth.

Figure 4:
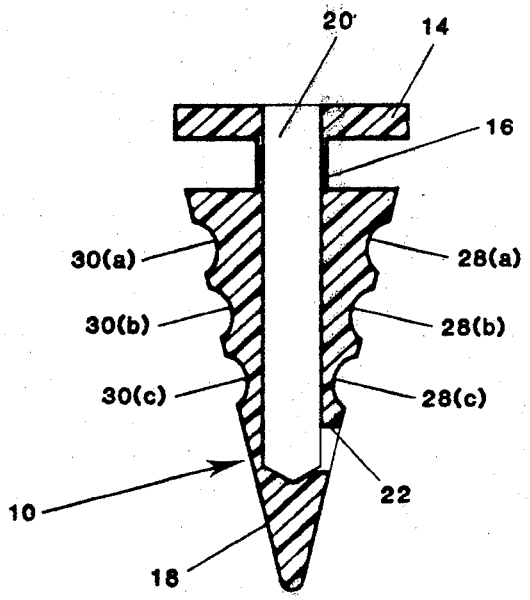
FIG. 4 is a cross-sectional view of another embodiment of the invention illustraing a dosing tip having a series of constriction elements on the mouth-receiving surface.

FIG. 4 of the drawing illustrates the dosing tip 10 in which there are three pairs of opposing indented constriction elements 28(*a*), 28(*b*), 28(*c*) and 30(*a*), 30(*b*), 30(*c*) provided on the tapered front end 18 of the tip 10. Thus, for a smaller animal the tip may only be inserted up to the first pair of constriction elements 28(*a*), 30(*a*) or, if required, up to the second set of elements 28(*b*), 30(*b*) or the third set 28(*c*), 30(*c*) until the elements are engaged by the teeth, gums, or jaws of the recipient. This provides for more versatility in the tip 10.

Figure 5:
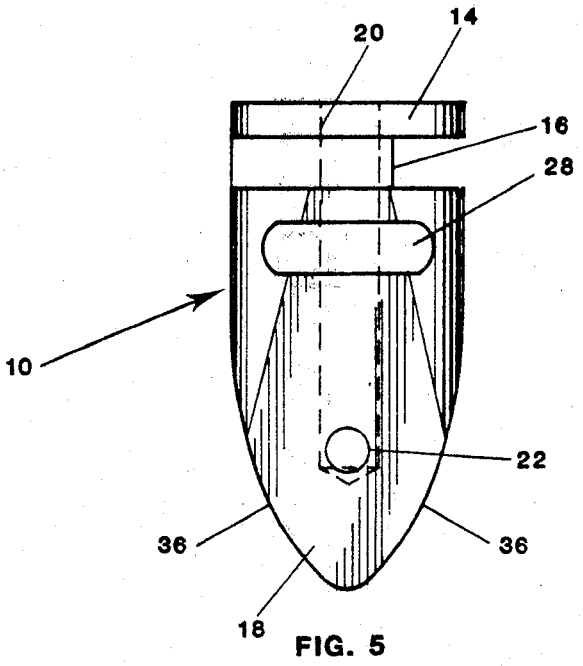
FIG. 5 is a top plan view of another embodiment of the invention illustrating a dosing tip having tapered sides.

Another embodiment of the tip 10 is shown in FIG. 5 in which a side portion 35 of the tip 10 is tapered toward the narrowed portion 18 of the tip end which provides for easier entry or removal of the tip which may be desirable when used with certain animals.

Figure 6:
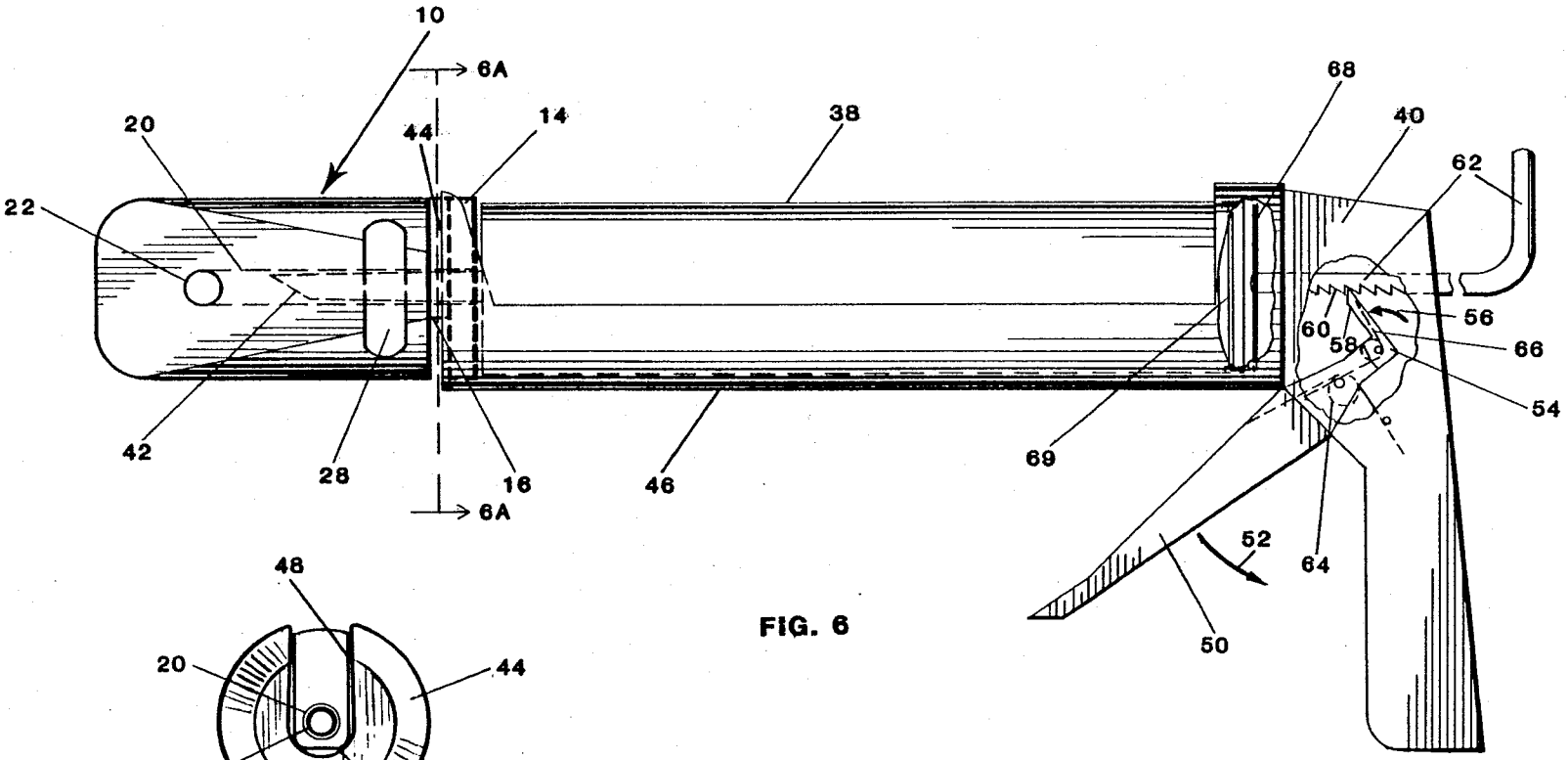
FIG. 6 is a side elevational view partially broken away illustrating the dosing tip of FIG. 1 joined with a conventional caulking gun tube mounted on a conventional caulking gun.
Figure 6A:
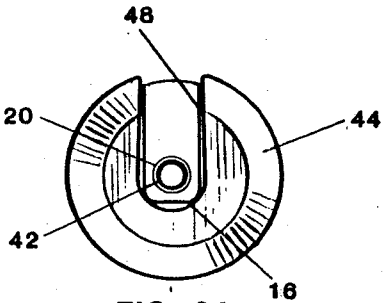
FIG. 6A is a sectional view taken along line 6A—6A in FIG. 6 showing a portion of the caulking gun and tube of FIG. 6.

FIG. 6 illustrates that the dosing tip 10 may be joined with a conventional caulking gun type tube 38 which is mounted on a caulking gun 40. The tube 38 thereof is filled with the medicament and the nozzle 42 of the tube 38 fits into the conduit means 20 of the dosing tip. The flange 14 of the tip 10 and neck portion 16 provide for the seating of the dosing tip 10 on the front of the caulking gun type tube 38. FIG. 6A is a sectional view showing a front disc-like element 44 of the caulking gun tube receiving cradle 46 (FIG. 6). A slot 48 is formed in the element 44 which receives the nozzle 42 of the tube 38. As shown, the flange 14 is seated directly behind element 44 and the neck portion 16 extends through slot 48 and is supported by the slot surrounding portions of element 44.

In operation of the caulking gun 38, referring to FIG. 6, the pulling of springbiased trigger 50 of the gun in the direction shown by the arrow 52 pivots a ratchet element 54 forward as shown by the arrow 56. The springbiased element 58 engages teeth 60 on a plunger 62 and drives the element 62 forward. Leaf spring elements 64 and 66 shown schematically in FIG. 6 bias trigger 50 and element 58 into their return position, as shown. A plunger disc 68 mounted on a plunger 62 engages a longitudinally slideable disc 69 which slides forward inside tube 38 when forcibly engaged by plunger disc 68 to force the medicament within tube 38 through the outlet 42 and out of opening 22 in the dosing tip 10 and into the recipient's mouth.

Figure 7:
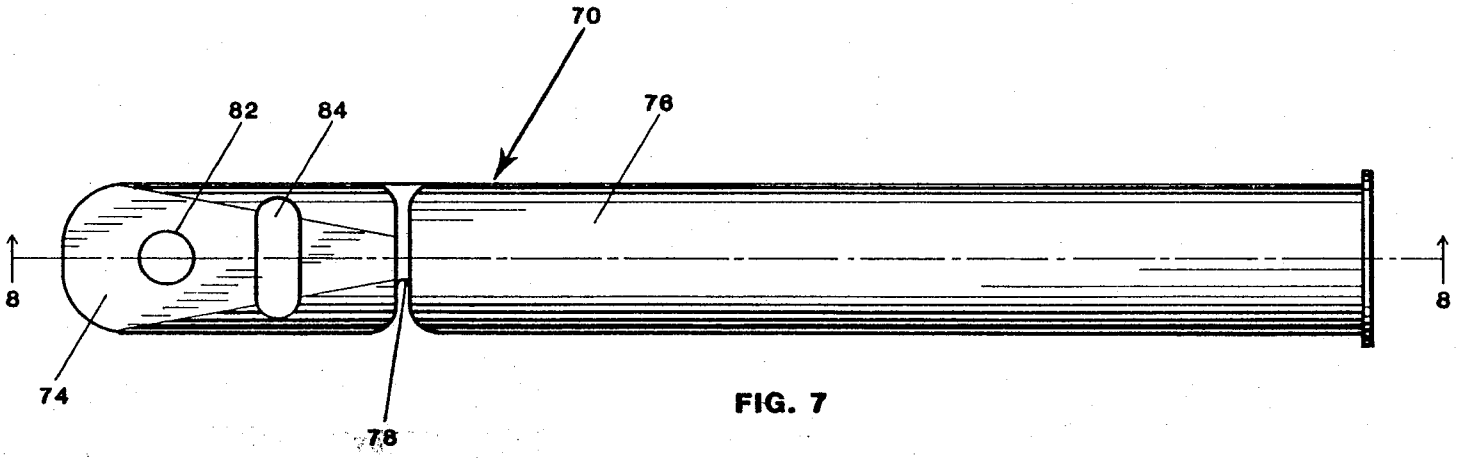
FIG. 7 is a side elevational view illustrating another embodiment of the invention wherein the dosing tip of FIG. 1 is an molded integral part of a medicament container.
Figure 8:
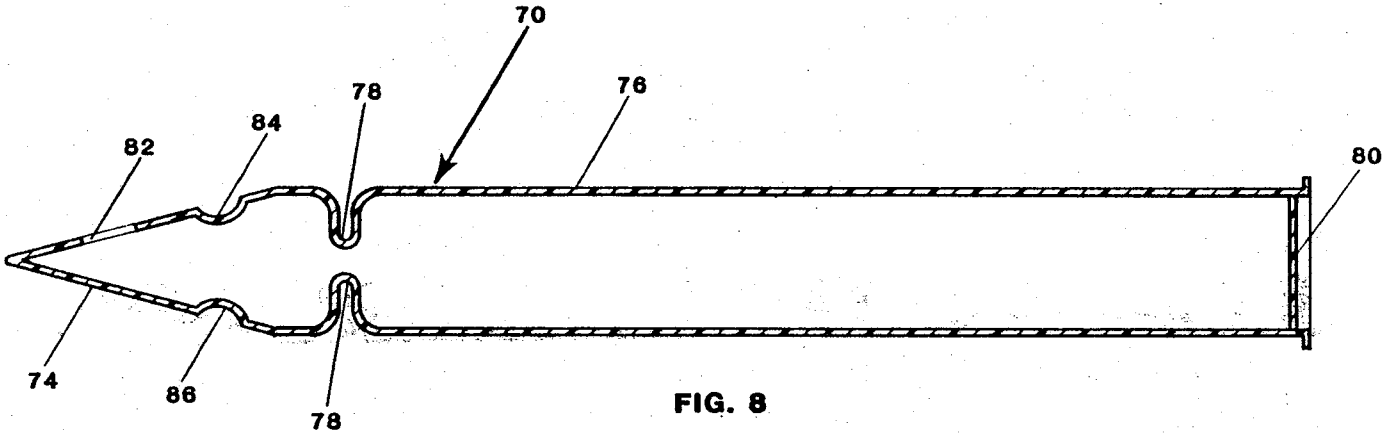
FIG. 8 is a sectional view taken along line 8—8 of FIG. 7.

FIGS. 7 and 8 of the invention illustrate another embodiment of the invention comprising a dosing tip 70 having a unitary body including a unitary tapered front-end portion 74 for insertion into the mouth of a recipient or host and a medicament containing chamber portion 76. A neck portion 78 is integrally formed as part of tip 70 and is received and held on the front of a caulking gun as shown in FIGS. 6 and 6A. A slideable extrusion disc 80 is seated at the rearward end of chamber 76 which disc 80 is engaged by a plunger of a common caulking gun such as plunger 68, as shown in FIG. 6, to extrude medicament out of aperture 82 in the tapered front-end portion 74 of the dosing tip 70. Opposed indented constriction element 84 and 86 are also formed integrally in the tip 70 utilized in the same manner and for the same purposes as previously described constriction elements 28 and 30 described above.

Figure 9:
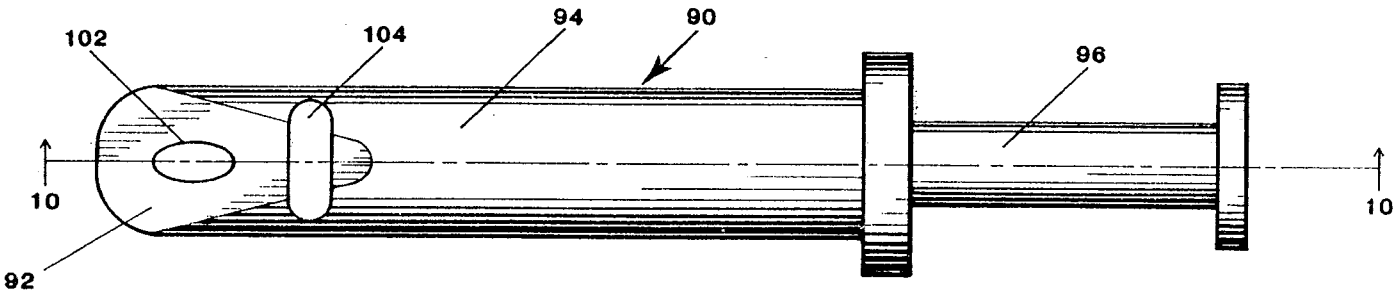
FIG. 9 is an elevational view illustrating another embodiment of the invention.
Figure 10:
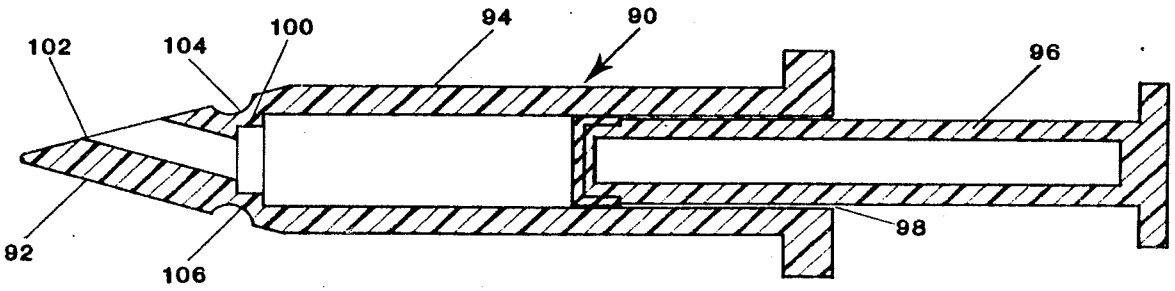
FIG. 10 is a sectional view taken on line 10—10 of FIG. 9.

Finally, FIGS. 9 and 10 illustrate an embodiment of the invention comprising a dosing tip 90 having a tapered mouth receiving portion 92 and a medicament holding body chamber portion 94 which forms an integral part of a syringe type device. A plunger 96 is slideably mounted on body portion 94 for passage through end 98 into chamber 94 to force the medicament out of chamber 94 through the outlet 100 and out of opening 102 and into the recipient's mouth. Also shown are the opposed indented constriction elements 104, 106 utilized in the same manner and for the same purposes as previously described constriction elements 28 and 30, described above.

While the preferred embodiments of the invention as described above depict the independently configured gripping means in the form of constriction elements such as shown at 28 and 30 in FIG. 1 as indentions in the tapered mouth receiving front end portion 18, it should be obvious that other forms of gripping means or constriction elements may be provided which are meant to come within the scope of the invention claimed herein. For example, the constriction elements could comprise slightly raised portions on the front end portion 18 either molded integrally therewith or added on in the form of separate elements affixed in place on end portion 18, or any combination of raised portions and indented portions, so long as the lips, teeth, gum, or jaws of the recipient are firmly engageable therewith.

The dosing tip of the invention may be fabricated from any suitable material. The body portions including the medicament holding chamber appears to be most easily and economically fabricated of a moldable plastic composition though various parts thereof may put other materials to advantageous use. The medicaments administered may be of a liquid, oleagenous, semi-solid, solid and the like nature which are easily administered with the use of the conventional caulking gun type delivery system described herein.

We claim:

1. A dosing tip for administering a dose of material to a host comprising:

(a) a body having a tapered end portion for insertion into the mouth of the host, said tapered end portion having at least one gripping means partially extending around the circumference of said tapered end portion for firmly engaging the host during the administration of the dose of material to the host and for disengaging the host by turning said body upon completion of the administration of the dose;

(b) an outlet in said tapered end portion for passing the dose of material from said tapered end portion to the host; and (c) a conduit extending through said body for passing said dose through said body to said outlet.

2. The dosing tip of claim 1, including:

(a) a material holding chamber at the end of said body opposite said tapered end portion for holding the material to be administered to the host; and (b) an integral neck portion extending between said material holding chamber and the end of said body.

3. The dosing tip of claim 2, wherein said material holding chamber includes plunger means for forcing the material toward said outlet.

4. A dosing tip for administering a dose of material to a host comprising:

(a) a body having a tapered end portion for insertion into the mouth of the host, said tapered end portion having at least one gripping means partially extending around the circumference of said tapered end portion for firmly engaging the host during the administration of the dose of material to the host and for disengaging the host upon turning said body, and wherein said at least one gripping means comprises at least one indented constriction element formed in said tapered end portion.

(b) an outlet in said tapered end portion for passing the dose of material from said tapered end portion to the host;

(c) a flange portion on the end of said body opposite said tapered end portion;

(d) a neck portion connecting said flange portion to said body;

(e) a conduit extending through said flange and neck portions and said body for passing said dose through said body to said outlet.

5. The dosing tip of claim 4 which further comprises:

a material holding chamber contiguous to said flange portion for holding the material to be administered to the host.

6. The dosing tip of claim 5 wherein said material holding chamber includes plunger means for forcing the material toward said outlet.

7. The dosing tip of claims 4, 5, or 6 wherein said at least one gripping means comprises one or more pairs of opposed indented constriction elements formed in said tapered end portion, each pair extending partially around the circumference of said tapered end portion to define a portion thereof for engaging the host and for easy removal of the dosing tip from the host upon turning said body.

8. The dosing tip according to claim 7 which further includes a flow regulator to control the flow of material from said outlet.

* * * * *